US010562147B2

(12) United States Patent
Butterfield et al.

(10) Patent No.: US 10,562,147 B2
(45) Date of Patent: Feb. 18, 2020

(54) POLISHING SYSTEM WITH ANNULAR PLATEN OR POLISHING PAD FOR SUBSTRATE MONITORING

(71) Applicant: Applied Materials, Inc., Santa Clara, CA (US)

(72) Inventors: Paul D. Butterfield, San Jose, CA (US); Thomas H. Osterheld, Mountain View, CA (US); Jeonghoon Oh, Saratoga, CA (US); Shou-Sung Chang, Mountain View, CA (US); Steven M. Zuniga, Soquel, CA (US); Fred C. Redeker, Fremont, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 15/691,416

(22) Filed: Aug. 30, 2017

(65) Prior Publication Data

US 2018/0056477 A1 Mar. 1, 2018

Related U.S. Application Data

(60) Provisional application No. 62/382,097, filed on Aug. 31, 2016, provisional application No. 62/445,371, filed on Jan. 12, 2017.

(51) Int. Cl.
*B24B 37/20* (2012.01)
*B24B 37/005* (2012.01)
(Continued)

(52) U.S. Cl.
CPC ..... *B24B 37/005* (2013.01); *B24B 37/013* (2013.01); *B24B 37/20* (2013.01);
(Continued)

(58) Field of Classification Search
CPC ... B24B 37/005; B24B 37/013; B24B 37/205; B24B 49/12
(Continued)

(56) References Cited

U.S. PATENT DOCUMENTS 5,081,796 A 1/1992 Schultz
5,498,196 A 3/1996 Karlsrud et al.
(Continued)

FOREIGN PATENT DOCUMENTS

WO WO 2011/088057 7/2011

OTHER PUBLICATIONS

International Search Report and Written Opinion in International Application No. PCT/US2017/049394, dated Feb. 12, 2018, 15 pages.

*Primary Examiner* — Eileen P Morgan
(74) *Attorney, Agent, or Firm* — Fish & Richardson P.C.

(57) ABSTRACT

A polishing system includes a platen having a top surface, an annular polishing pad supported on the platen, a carrier head to hold a substrate in contact with the annular polishing pad, a support structure from which the carrier head is suspended and which is configured to move the hold the carrier head laterally across the polishing pad, and a controller. The platen is rotatable about an axis of rotation that passes through approximately the center of the platen, and the inner edge of the annular polishing pad is positioned around the axis of rotation. The controller is configured to cause the support structure to position the carrier head such that a portion of the substrate overhangs the inner edge of the annular polishing pad while the substrate is contacting the polishing pad.

11 Claims, 6 Drawing Sheets

(51) Int. Cl.
*B24B 37/013* (2012.01)
*B24B 49/12* (2006.01)
*B24B 41/02* (2006.01)
*B24B 53/02* (2012.01)

(52) U.S. Cl.
CPC ..... *B24B 37/205* (2013.01); *B24B 41/02* (2013.01); *B24B 49/12* (2013.01); *B24B 53/02* (2013.01)

(58) Field of Classification Search
USPC ..... 451/5, 41, 285
See application file for complete search history.

(56) References Cited

U.S. PATENT DOCUMENTS 5,658,183 A 8/1997 Sandhu et al.
6,159,073 A * 12/2000 Wiswesser ..... B24B 37/04 451/288
6,386,963 B1 * 5/2002 Kenji ..... B24B 53/017 451/443
6,599,765 B1 * 7/2003 Boyd ..... B24B 37/205 356/630
6,876,454 B1 * 4/2005 Birang ..... B24B 37/013 356/503
2002/0127953 A1 * 9/2002 Doan ..... B24B 37/11 451/41
2003/0020009 A1 * 1/2003 Sugiyama ..... B24B 37/013 250/234
2003/0136684 A1 * 7/2003 Duboust ..... B23H 5/08 205/640
2003/0148706 A1 * 8/2003 Birang ..... B24B 37/013 451/6
2004/0192169 A1 * 9/2004 Kimura ..... B24B 37/205 451/5
2007/0021037 A1 1/2007 Birang et al.
2007/0197132 A1 * 8/2007 Menk ..... B24B 21/04 451/5
2008/0003923 A1 * 1/2008 Benvegnu ..... B24B 37/205 451/6
2008/0305729 A1 * 12/2008 Benvegnu ..... B24B 37/013 451/530
2009/0318061 A1 * 12/2009 Taylor ..... B24B 37/205 451/6
2010/0184357 A1 * 7/2010 Qian ..... B24B 37/013 451/6
2010/0269417 A1 * 10/2010 Swedek ..... B24B 37/205 51/298
2010/0330879 A1 * 12/2010 Paik ..... B24B 37/205 451/6
2011/0256818 A1 * 10/2011 Swedek ..... B24B 37/205 451/540
2014/0127971 A1 * 5/2014 Xu ..... B24B 7/228 451/5
2014/0206259 A1 * 7/2014 Benvegnu ..... B24B 49/12 451/6
2016/0016284 A1 * 1/2016 Gurusamy ..... B24B 53/017 451/56

* cited by examiner

POLISHING SYSTEM WITH ANNULAR PLATEN OR POLISHING PAD FOR SUBSTRATE MONITORING

CROSS-REFERENCE TO RELATED APPLICATIONS

This application claims priority to U.S. Provisional Application Ser. No. 62/382,097, filed on Aug. 31, 2016, and claims priority to U.S. Provisional Application Ser. No. 62/445,371, filed on Jan. 12, 2017, the disclosures of which are incorporated by reference.

TECHNICAL FIELD

The present disclosure relates to monitoring during chemical mechanical polishing of substrates.

BACKGROUND

An integrated circuit is typically formed on a substrate by the sequential deposition of conductive, semiconductive, or insulative layers on a silicon wafer. One fabrication step involves depositing a filler layer over a non-planar surface and planarizing the filler layer. For certain applications, the filler layer is planarized until the top surface of a patterned layer is exposed. A conductive filler layer, for example, can be deposited on a patterned insulative layer to fill the trenches or holes in the insulative layer. After planarization, the portions of the conductive layer remaining between the raised pattern of the insulative layer form vias, plugs, and lines that provide conductive paths between thin film circuits on the substrate. For other applications, such as oxide polishing, the filler layer is planarized until a predetermined thickness is left over the non planar surface. In addition, planarization of the substrate surface is usually required for photolithography.

Chemical mechanical polishing (CMP) is one accepted method of planarization. This planarization method typically requires that the substrate be mounted on a carrier or polishing head. The exposed surface of the substrate is typically placed against a rotating polishing pad. The carrier head provides a controllable load on the substrate to push it against the polishing pad. An abrasive polishing slurry is typically supplied to the surface of the polishing pad.

One problem in CMP is determining whether the polishing process is complete, i.e., whether a substrate layer has been planarized to a desired flatness or thickness, or when a desired amount of material has been removed. Variations in the slurry distribution, the polishing pad condition, the relative speed between the polishing pad and the substrate, and the load on the substrate can cause variations in the material removal rate. These variations, as well as variations in the initial thickness of the substrate layer, cause variations in the time needed to reach the polishing endpoint. Therefore, the polishing endpoint cannot be determined merely as a function of polishing time.

In some systems, a substrate is optically monitored in-situ during polishing, e.g., through a window in the polishing pad.

SUMMARY

In one aspect, a polishing system includes a platen, a carrier head to hold a substrate, and an in-situ monitoring system. The platen has a top surface and an aperture in the top surface in approximately a center of the platen such that the top surface is an annular surface to support an annular polishing pad. The platen is rotatable about an axis of rotation that passes through approximately the center of the platen. The in-situ monitoring system has a probe positioned in or below the aperture and configured to monitor a portion of the substrate that overhangs an inner edge of the annular surface.

Implementations may include one or more of the following features.

The aperture may be a recess extending partially but not entirely through the platen. The probe may be supported on a bottom surface of the recess, or the probe may be positioned in the platen and have a top surface flush with a bottom surface of the recess. The platen may have a conduit for liquid polishing residue to drain from the recess.

The aperture may be a passage extending entirely through the platen. A ring bearing may support platen. The probe may be supported on a structure that extends vertically through the ring bearing. The probe may be positioned in a stationary position in the aperture in the platen. The probe may be secured to a side wall of the aperture of the platen.

The in-situ monitoring system may include an optical monitoring system. A diameter of the aperture may be about 5% to 40% of a diameter of the platen. An actuator may cause the carrier head to move laterally across the polishing pad, and a controller may be configured to cause the actuator to move the carrier head such the portion of the substrate overhangs the inner edge of the annular surface. The controller may be configured to cause the actuator to move the carrier head such the portion of the substrate overhangs the inner edge of the annular surface before and/or after a polishing operation on the substrate. The annular polishing pad may have a polishing layer uninterrupted by window.

In another aspect, a polishing system includes a platen having a top surface to support an annular polishing pad, a carrier head to hold a substrate in contact with the annular polishing pad, a support structure extending above the platen and to which one or more polishing system components are secured, and a support post. The platen is rotatable about an axis of rotation that passes through approximately a center of the platen. The first support post has an upper end coupled to and supporting the support structure and a lower portion that is supported on the platen or that extends through an aperture in the platen.

Implementations may include one or more of the following features.

The one or more components may include one or more of the carrier head, a conditioner head, a polishing liquid delivery system, or a pad cleaner. An actuator on the support structure may move the one or more components laterally across the platen. A second support post may be positioned to a side of the platen. The second support post may have an upper end coupled to and supporting the support structure and a lower end on a stationary support. The stationary support may include a frame supporting the platen. The polishing pad has an annular shape with an aperture positioned at about the center of the platen.

The first support post may extend through the aperture in the platen and the lower end may be secured to the frame. An in-situ monitoring system may have a probe positioned in the aperture through the platen.

The lower end of the first support post may be supported on the platen. A rotary bearing may couple the platen to the support post, or a rotary bearing may couple the support post to the support structure. The support post may be substantially collinear with the axis of rotation. The platen may have a recess in the top surface of the platen in approximately the center of the platen, and the lower portion of the first support post may extend into the recess. The first support post may be supported on the top surface of the platen that supports the polishing pad. An in-situ monitoring system may have a probe positioned in or below the recess.

In another aspect, a polishing system includes a platen having a top surface, the platen rotatable about an axis of rotation that passes through approximately the center of the platen, an annular polishing pad supported on the platen with the inner edge of the annular polishing pad around the axis of rotation, a carrier head to hold a substrate in contact with the annular polishing pad, a support structure from which the carrier head is suspended, the support structure configured to move the carrier head laterally across the polishing pad, and a controller configured to cause the support structure to position the carrier head such that a portion of the substrate overhangs the inner edge of the annular polishing pad while the substrate is contacting the polishing pad.

Implementations may include one or more of the following features.

The system may be configured such that only a single carrier head at a time holds a substrate in contact with the annular polishing pad. A center of an aperture that provides the inner edge of the annular polishing pad may be aligned with the axis of rotation. An in-situ monitoring system may have a probe positioned to monitor the portion of the substrate that overhangs the inner edge of the annular polishing pad. The annular polishing pad may include a polishing layer uninterrupted by a window.

The platen may have an aperture in the top surface in approximately a center of the platen such that the top surface is an annular surface to support the annular polishing pad. The aperture may be a recess extending partially but not entirely through the platen. The conduit may extend through the platen for liquid polishing residue to drain from the recess. The aperture may be a passage extending entirely through the platen. A support post may support one or more polishing system components, and the support post may have a lower portion that is supported on the platen or that extends through an aperture in the platen.

Implementations may optionally include one or more of the following advantages. A portion of the surface area of the polishing pad with superior performance can be dedicated to polishing, while providing in-situ monitoring. This can provide an increased polishing rate. Problems such as insufficient cleaning, insufficient conditioning and higher surface temperature can be reduced. Polishing by-product can be disposed of through the center area, and thus by-product management may be improved and defects reduced. Synchronizing motion of various components to avoid collision may be easier or unnecessary. Support structures for various components can make contact with the center area of the platen. As a result, cantilever structures may be avoided and mechanical stability improved, and vibration and noise may be reduced.

The details of one or more implementations are set forth in the accompanying drawings and the description below. Other aspects, features, and advantages will be apparent from the description and drawings, and from the claims.

BRIEF DESCRIPTION OF THE DRAWINGS

Like reference numbers and designations in the various drawings indicate like elements.

DETAILED DESCRIPTION

In some optical endpoint detection systems, the optical monitoring window is placed near the middle of the radius of the platen, such that the window will sweep below the substrate. However, placement of a window in the polishing surface can reduce the polishing rate. As a separate issue, the center region of the polishing pad has a lower linear velocity as compared to other regions of the polishing pad. This can result in several problems, such as insufficient cleaning, insufficient pad conditioning, and a higher temperature, all of which can reduce polishing uniformity. And as another separate issue, support structures for various components, e.g., conditioner, are typically configured as cantilevers mounted outside the platen and extending over the platen. Such cantilever structures can be prone to vibration, which can create noise or effect uniformity. By configuring the polishing pad (and optionally platen) in an annular configuration, the center aperture can be used for monitoring and/or for support of other structures, or simply be left unused, which can address one or more of these problems.

Figure 1:
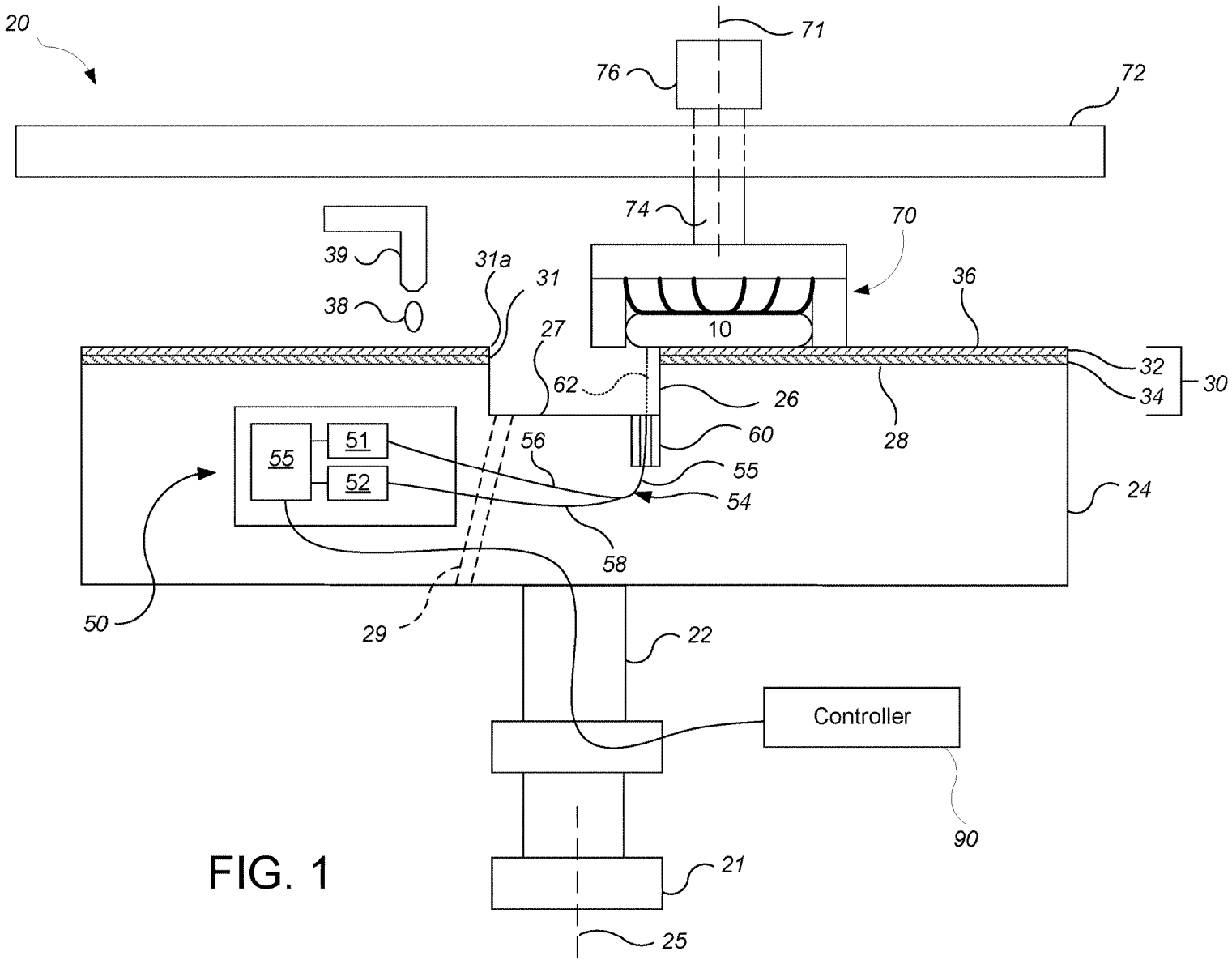
FIG. 1 shows a schematic cross-sectional view of a chemical mechanical polishing system.
Figure 2:
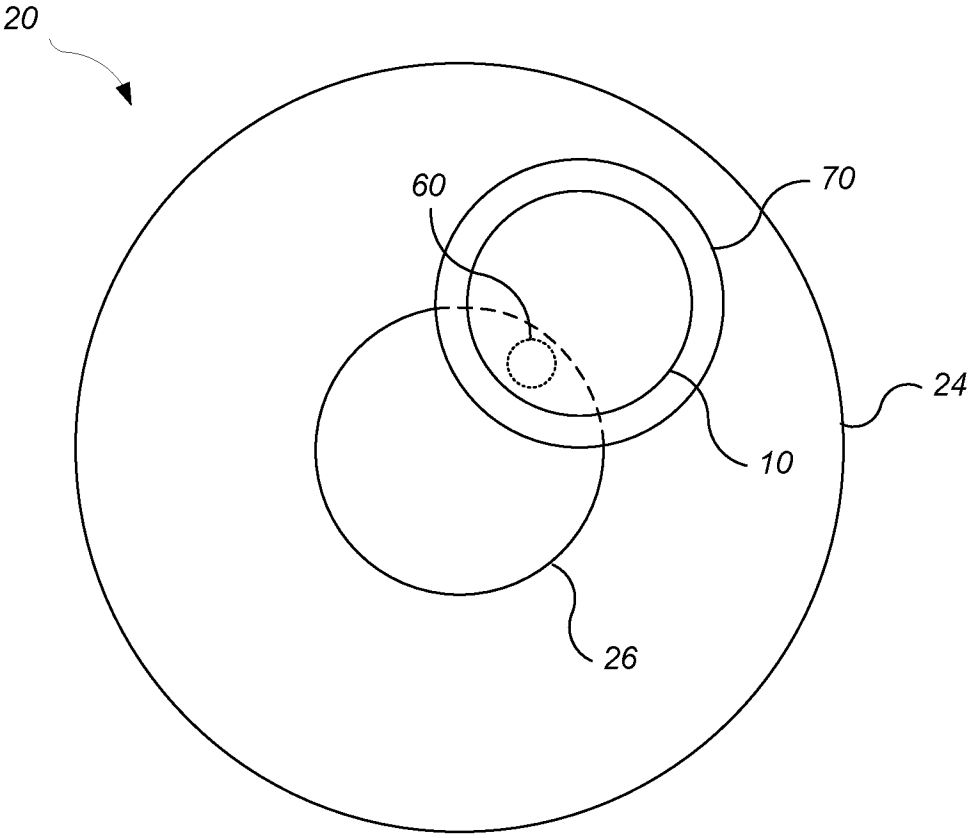
FIG. 2 shows a schematic top view of the chemical mechanical polishing system of FIG. 1.

FIGS. 1 and 2 show a polishing system 20 operable to polish a substrate 10. The polishing system 20 includes a rotatable platen 24, on which an annular polishing pad 30 is situated. A hole 31 is formed at least through the polishing pad 30 to provide the annular shape.

The platen is operable to rotate about an axis 25. For example, a motor 21 can turn a drive shaft 22 to rotate the platen 24. In some implementations, the platen 24 is configured to provide an annular upper surface 28 to support the annular polishing pad 30. To provide the annular upper surface 28, an aperture 26 is formed in the upper surface 28 at the center of the platen 24. A center of the aperture 26 can be aligned with the axis of rotation 25. For example, the aperture 26 can be circular and the center of the aperture 26 can be co-axial with the axis of rotation 25.

In some implementations, the aperture 26 is a recess that extends partially but not entirely through the platen 24. In some implementations, the aperture 26 provides entirely through the platen 24 (see FIG. 3), e.g., the aperture 26 provides a passage through the platen 24. In some implementations, the aperture 26 (either as a recess or a passage) includes two portions, an upper portion 26*a* with a first diameter and a lower potion 26*b* with a different, e.g., smaller diameter.

The diameter of the aperture 26 (e.g., the portion adjacent the surface 28, either as a recess or as an upper portion of the passage through the platen 24) can be about 5% to 40% of the diameter of the platen 24, e.g., about 5% to 15%, or 20% to 30%. For example, the diameter can be 3 to 12 inches in a 30 to 42 inch diameter platen.

The polishing pad 30 can be secured to the upper surface 28 of the platen 24, for example, by a layer of adhesive. When worn, the polishing pad 30 can be detached and replaced. The polishing pad 30 can be a two-layer polishing pad with an outer polishing layer 32 having a polishing surface 36, and a softer backing layer 34. The polishing pad 30 has an inside edge 35 which defines the perimeter of the aperture 26 through the pad 30. The inner edge 35 of the pad 30 can be circular.

The diameter of the hole 31 through the polishing pad can be about 5% to 40% of the diameter of the polishing pad 30, e.g., about 5% to 15%, or 20% to 30%. For example, the diameter can be 3 to 12 inches in a 30 to 42 inch diameter polishing pad. Where the platen includes the aperture (e.g., as shown in FIGS. 1, 3, 5 and 6), the diameter of the hole 31 through the polishing pad 30 should be at least as large as the diameter of the aperture 26 in the platen 24.

A center of the hole 31 can be aligned with the axis of rotation 25. For example, the hole 31 can be circular and the center of the hole 31 can be co-axial with the axis of rotation 25.

The polishing system 20 can include a polishing liquid deliver arm 39 and/or a pad cleaning system such as a rinse fluid deliver arm. During polishing, the arm 39 is operable to dispense a polishing liquid 38, e.g., slurry with abrasive particles. In some implementations, the polishing system 20 include a combined slurry/rinse arm. Alternatively, the polishing system can include a port in the platen operable to dispense the polishing liquid onto polishing pad 30.

The polishing system 20 includes a carrier head 70 operable to hold the substrate 10 against the polishing pad 30. The carrier head 70 is suspended from a support structure 72, for example, a carousel or track, and is connected by a carrier drive shaft 74 to a carrier head rotation motor 76 so that the carrier head can rotate about an axis 71. In addition, the carrier head 70 can oscillate laterally across the polishing pad, e.g., by moving in a radial slot in the carousel as driven by an actuator, by rotation of the carousel as driven by a motor, or movement back and forth along the track as driven by an actuator. In operation, the platen 24 is rotated about its central axis 25, and the carrier head is rotated about its central axis 71 and translated laterally across the top surface of the polishing pad.

In some implementations, only a single carrier head 70 at a time can be positioned over and lower a substrate 10 into contact with the polishing pad 30. For example, a polishing system can include multiple independently rotatable platens and multiple carrier heads suspended from a support structure, e.g., as described in U.S. Pat. No. 9,227,293, but the polishing system 20 is configured such that only a single carrier head 70 is used for a particular polishing pad 30.

The carrier head 70 can be laterally positioned such that the substrate 10 partially overhangs the hole 31 in the polishing pad 30 during polishing. Due to the hole 31, the center region of the polishing pad is not used, which can improve uniformity and reduce defects. Having only a single carrier head 70 for the polishing pad 30 can reduce a risk of cross-contamination between substrates.

Where the platen 24 includes the aperture, the carrier head 70 can be laterally positioned during polishing such that the substrate 10 partially overhangs the aperture 26 in the platen 24 and hole 31 in the polishing pad 30.

The polishing system 20 can include an in-situ substrate monitoring system 50, e.g., an optical monitoring system, e.g., a spectrographic optical monitoring system, which can be used to determine a polishing endpoint. As an optical monitoring system, the in-situ substrate monitoring system 50 includes a light source 51 and a light detector 52. Light passes from the light source 51, through the aperture 26 in the platen 24 and the polishing pad 30, impinges and is reflected from the substrate 10 and travels to the light detector 52

The in-situ substrate monitoring system 50 can include a probe 60 positioned in or below the aperture 26 in the platen 24. The probe 60 is positioned is positioned below the top surface 28 of the platen 24. The probe 60 can be positioned entirely in the aperture 26, e.g., sitting on the bottom surface 27. Alternatively, the probe 60 can be located in the platen such that the top of the probe 60 is flush with or below the bottom surface 27 of the aperture 26. Alternatively, the probe 60 can be positioned partially in the platen below the bottom surface 27 and partially in the aperture 26 above the bottom surface 27.

In the case of an optical monitoring system, light will be transmitted in a beam 62 from the probe 60 to the substrate 10. Similarly, light can be reflected back from the substrate 10 to the probe 60. The probe 60 is supported by the platen 24 and can rotate with the platen 24.

For example, a bifurcated optical cable 54 can be used to transmit the light from the light source 51 to the probe 60 and back from the probe 60 to the light detector 52. The bifurcated optical cable 54 can include a "trunk" 55 and two "branches" 56 and 58. One branch 56 can be coupled to the light source 51, and the other branch 58 can be coupled to the detector 52. The probe 60 can hold the end of the trunk 55 of the bifurcated fiber cable 54. Thus, the light source 51 is operable to transmit light, which is conveyed through the branch 56 and out the end of the trunk 55 located in the probe 60, and which impinges on a substrate 10 being polished. Light reflected from the substrate 10 is received at the end of the trunk 55 located in the optical head 53 and conveyed through the branch 58 to the light detector 52.

The probe 60 can simply be an end of an optical fiber. Alternatively, the probe 60 can include one or more lenses or a window overlying the end of the optical fiber, or mechanical features to hold the end of the optical fiber.

An output of the detector 52 can be a digital electronic signal that passes through a rotary coupler, e.g., a slip ring, in the drive shaft 22 to a controller 90 for the monitoring system 50 and polishing system 20. Similarly, if the monitoring system 50 is an optical monitoring system, the light source 51 can be turned on or off in response to control commands in digital electronic signals that pass from the controller 90 through the rotary coupler to the module 50.

In some implementations, the platen 24 includes a removable in-situ monitoring module. For an optical monitoring system, the in-situ monitoring module can include one or more of the following: the light source 51, the light detector 52, and circuitry for sending and receiving signals to and from the light source 51 and light detector 52.

The light source 51 can be a white light source. In one implementation, the white light emitted includes light having wavelengths of 200-800 nanometers. A suitable light source is a xenon lamp or a xenon-mercury lamp.

The light detector 52 can be a spectrometer. A spectrometer is basically an optical instrument for measuring properties of light, for example, intensity, over a portion of the electromagnetic spectrum. A suitable spectrometer is a grating spectrometer. Typical output for a spectrometer is the intensity of the light as a function of wavelength. The spectrometer 52 typically has an operating wavelength band, e.g., 200-800 nanometers, or 250-1100 nanometers.

The light source 51 and light detector 52 are connected to the controller 90 which is operable to control their operation and to receive their signals.

Rather than an optical monitoring system, the in-situ substrate monitoring system 50 could be an eddy current monitoring system. In this case, the probe 60 could be a core with a coil wound around the core to generate a magnetic field.

The controller 90 can include a computer having a microprocessor and situated near the polishing system, e.g., a personal computer, to receive signals from the in-situ monitoring system 50. The controller 90 can also be programmed to use data collected from the substrate 10 to detect a polishing endpoint and cause the system 20 to halt polishing and/or adjust polishing parameters applied during polishing to the substrate improve polishing uniformity.

By not using a window near the midpoint of the radius of the polishing pad, a larger portion of the surface area of the polishing pad with superior performance can be dedicated to polishing. On the other hand since the probe 60 can be located in the aperture 26, the system can still provide in-situ monitoring.

Figure 3:
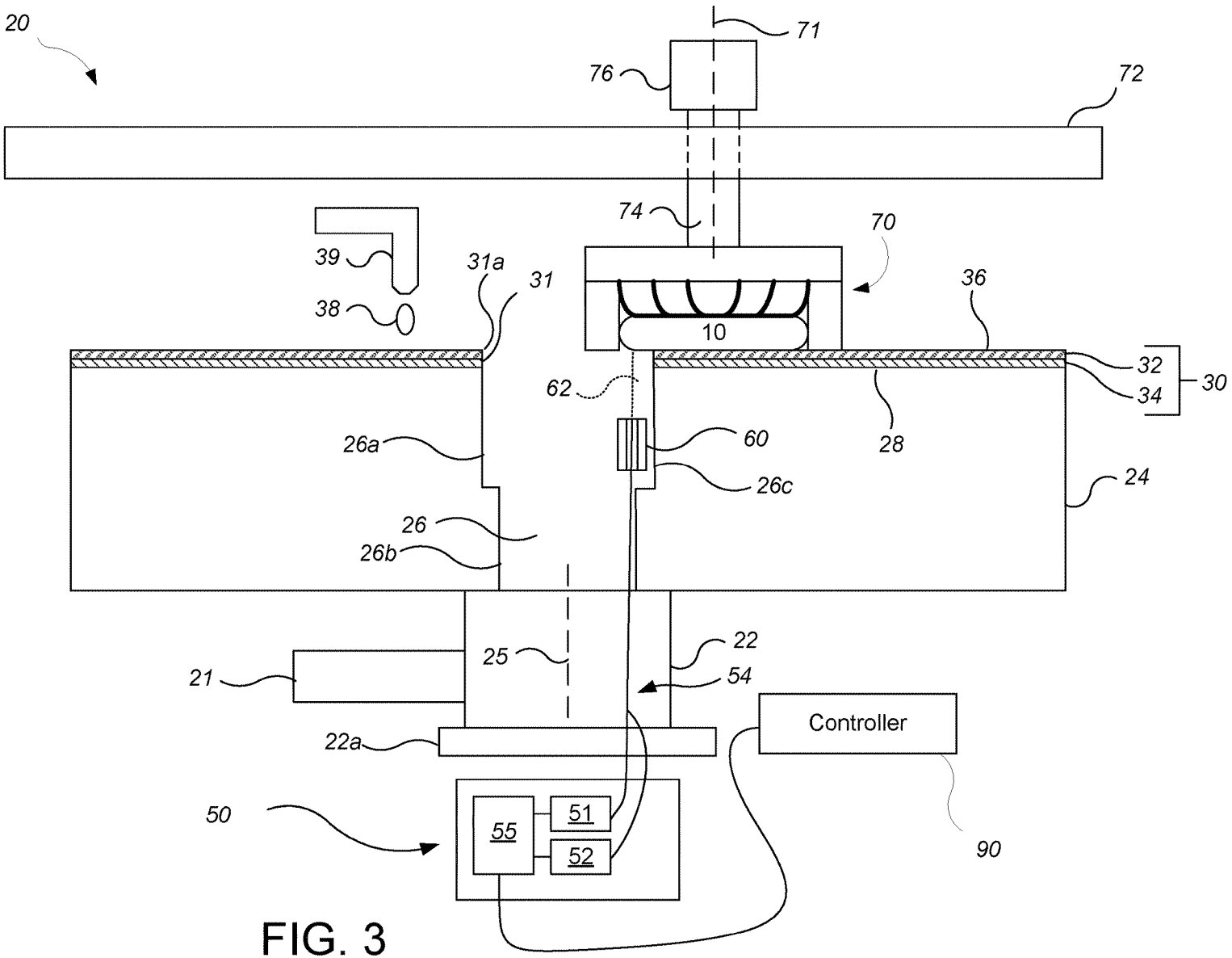
FIG. 3 shows a schematic cross-sectional view of a chemical mechanical polishing system in which an aperture passes entirely through the platen.

Referring to FIG. 3, as described above, in some implementations the aperture 26 passes entirely through the platen 24. In this case, the platen 24 is itself an annular body. For this configuration, the drive shaft 22 can be a cylindrical body, and can be supported on or be provided by a ring bearing 22*a*, which in turn is supported on the frame of the polishing system 20. In some implementations, the drive motor 21 can be coupled to the outside of the drive shaft 22 above the ring bearing 22*a*.

If the polishing system 20 include an in-situ substrate monitoring system 50, the optical probe 60 can positioned in the aperture 26. In particular, the probe 60 can be freestanding within the aperture 26, i.e., it remains stationary while the platen 24 rotates. Similarly, the in-situ monitoring module can remains stationary while the platen 24 rotates. The probe 60 can be supported by a structure that extends vertically through the ring bearing 22*a* and inside of the drive shaft 22.

Alternatively, the probe 60 could be secured to an inside wall, e.g., on the vertical wall 26*c* of the aperture 26 or on a ledge between the upper portion 26*a* and lower portion 26*b* of the aperture 26. Alternatively, the probe 60 could be positioned around a midpoint of a radius of the platen 24 and optical access through the polishing pad could be provided by a window (see FIG. 4). In these two cases, the probe 60 will rotate with the platen 24.

Figure 4:
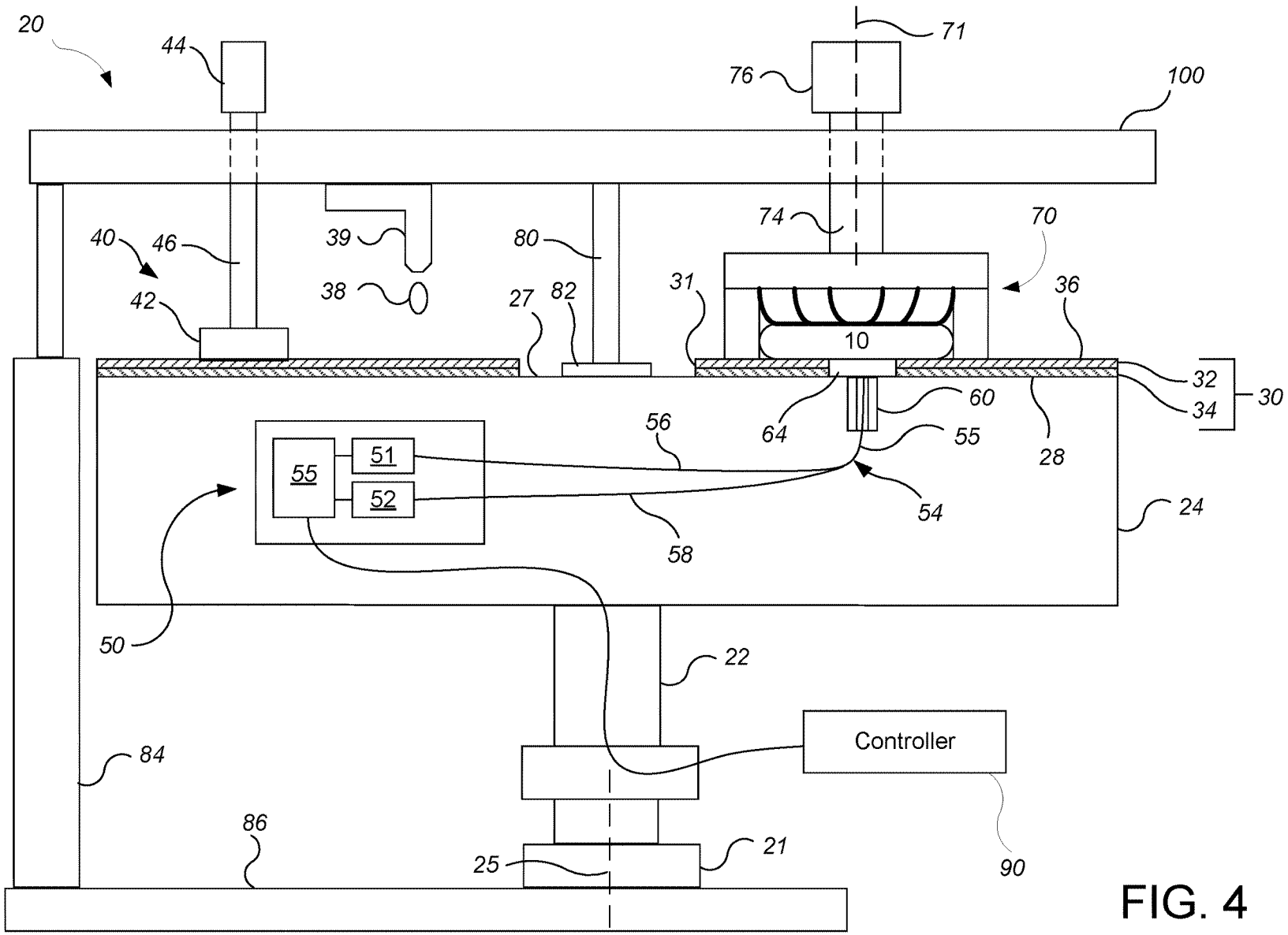
FIG. 4 shows a schematic cross-sectional view of a chemical mechanical polishing system in which one or more structures are supported on the platen.
Figure 5:
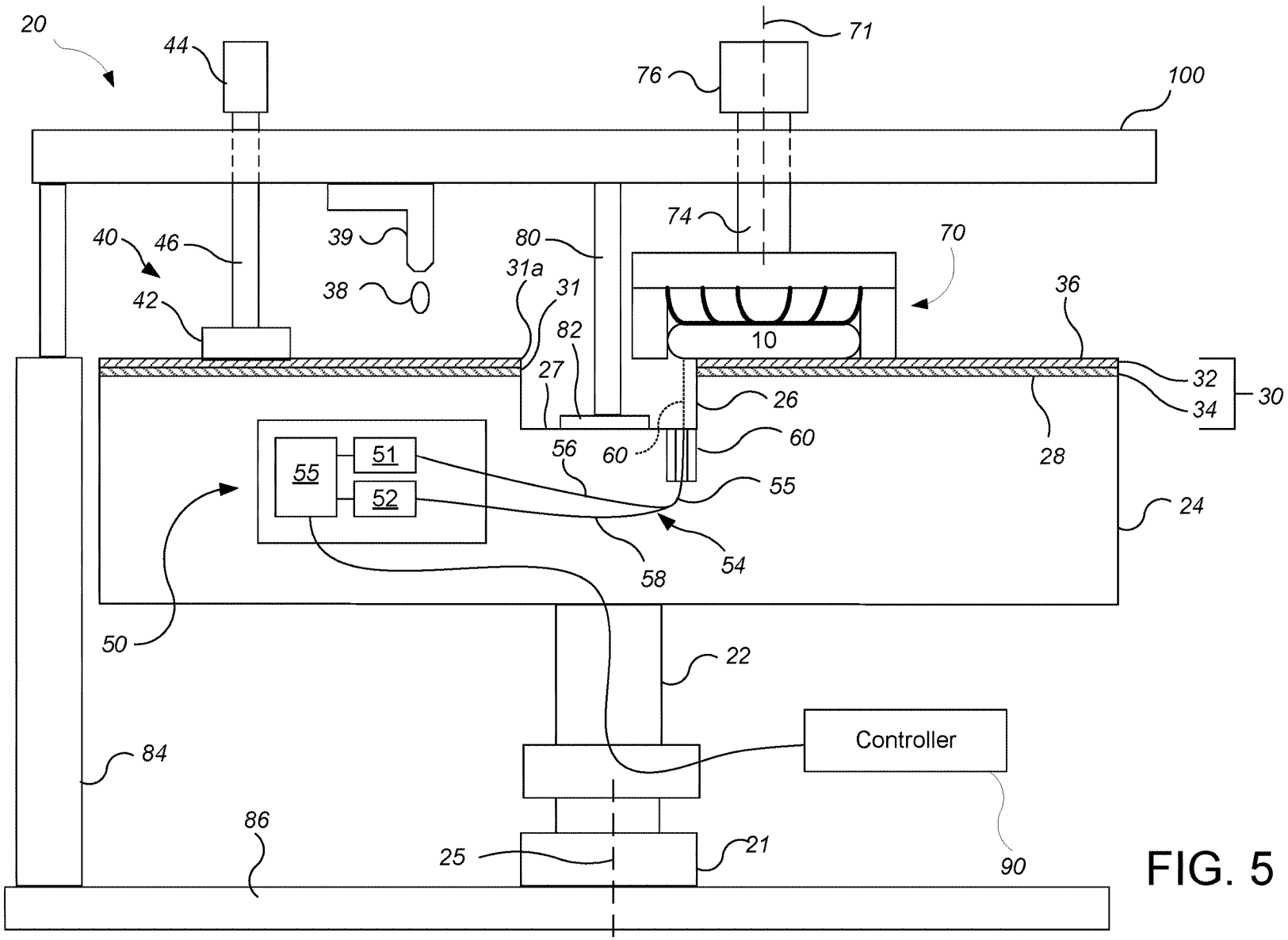
FIG. 5 shows a schematic cross-sectional view of a chemical mechanical polishing system in which one or more structures are itself supported in a recess on the platen.

Referring to FIGS. 4 and 5, in some implementations, one or more structures can be supported by the platen 24, particularly at the center of the platen 24. These structures can in turn support one or more other components of the polishing system, e.g., the carrier head 70, a polishing liquid delivery system, such as delivery arm, a pad cleaning system such as a cleaning fluid delivery arm, and/or a conditioning system 40. In these implementations, an aperture 26 is formed through the polishing pad 30 at the center of the platen, e.g., at the axis of rotation 25.

In the implementation shown in FIGS. 4 and 5, the polishing system 20 includes a support structure 100 that extends over the platen 24. The support structure 100 is at least partially supported by a support post 80 that is in turn supported by the platen 24. For example, a rotary bearing 82 can be supported on the platen 24, and a lower end of the support post 80 can be supported on the bearing 82. The upper end of the support post 80 is coupled to the support structure 100. Alternatively, the rotary bearing 82 can be located at the upper end of the support post 80 and connect the support post 80 to the support structure 100. The axis of rotation of the bearing 82 can be collinear with the axis of rotation 25 of the platen 24. Similarly, the support post 80 can be generally collinear with the axis of rotation 25 of the platen 24.

As shown in FIG. 4, the platen need not have the recess 26 at the center of the platen. For example, the support post 80 can be supported on the same surface 28 to which the polishing pad 30 is attached. For example, the bearing 82 can be positioned on or above the surface 28. For these implementations, if there is an in-situ monitoring system 50, the probe 60 can be positioned around the middle of a radius of the platen, and optical access through the polishing pad 30 can be provided by a window 64.

Alternatively, as shown in FIG. 5, the platen can include the recess 26 at the center of the platen. For example, the support post 80 can project into the recess 26 and/or the bearing 82 can be positioned on the bottom surface 27 of the recess 26. For these implementations, if there is an in-situ monitoring system 50, the support post 80 and the probe share the recess 26. For example, the probe 60 can be positioned as discussed above for FIG. 1. The support post 80 can be positioned in the center of the recess 26 without blocking the probe 60 or beam 62. Alternatively, the probe 60 can be positioned around the middle of a radius of the platen, and optical access through the polishing pad 30 can be provided by a window 64, as discussed above for FIG. 4.

Referring to FIGS. 4 and 5, the support structure 100 can also be partially supported by second support post 84 positioned to the side of the platen 24. The second support post 84 can itself be supported by a stationary frame 86, e.g., the frame that supports the platen 24. By having two support points, one outside the platen 24 and one above the platen 24, vibration and noise of the support structure 100 can be reduced as compared to a cantilevered structure that projects over the platen but is supported only outside the platen.

It should be understood that a variety of shapes are possible for the support posts 80 and 84; they need not be simple beams so long as they perform the function of supporting the support structure 100.

The support structure 100 can be the support structure 72 for the carrier head 70. Alternatively or in addition, the support structure 100 can support the polishing fluid delivery arm 39. Alternatively or in addition, the support structure 100 can support the pad cleaning system. Alternatively or in addition, the support structure 100 can support the conditioner system 40.

The conditioner system 40 can include a rotatable conditioner head 42, which can include an abrasive lower surface, e.g. on a removable conditioning disk, to condition the polishing surface 36 of the polishing pad 30. The conditioner system 40 can also include a motor 44 to drive the conditioner head 42, and a drive shaft 46 connecting the motor to the conditioner head 42. The conditioner system 40 can also include an actuator configured to sweep the conditioner head 40 laterally across the polishing pad 30.

One or more of the carrier head 70, polishing fluid deliver arm 39, pad cleaning system, and/or the conditioner head 42 that are supported from the support structure 100 can be configured to slide laterally along the support structure 100. For example, a linear actuator could be provided for each of the one or more components to provide the lateral motion. The one or more components could slide in a slot in the support structure, or move back and forth along a track.

Figure 6:
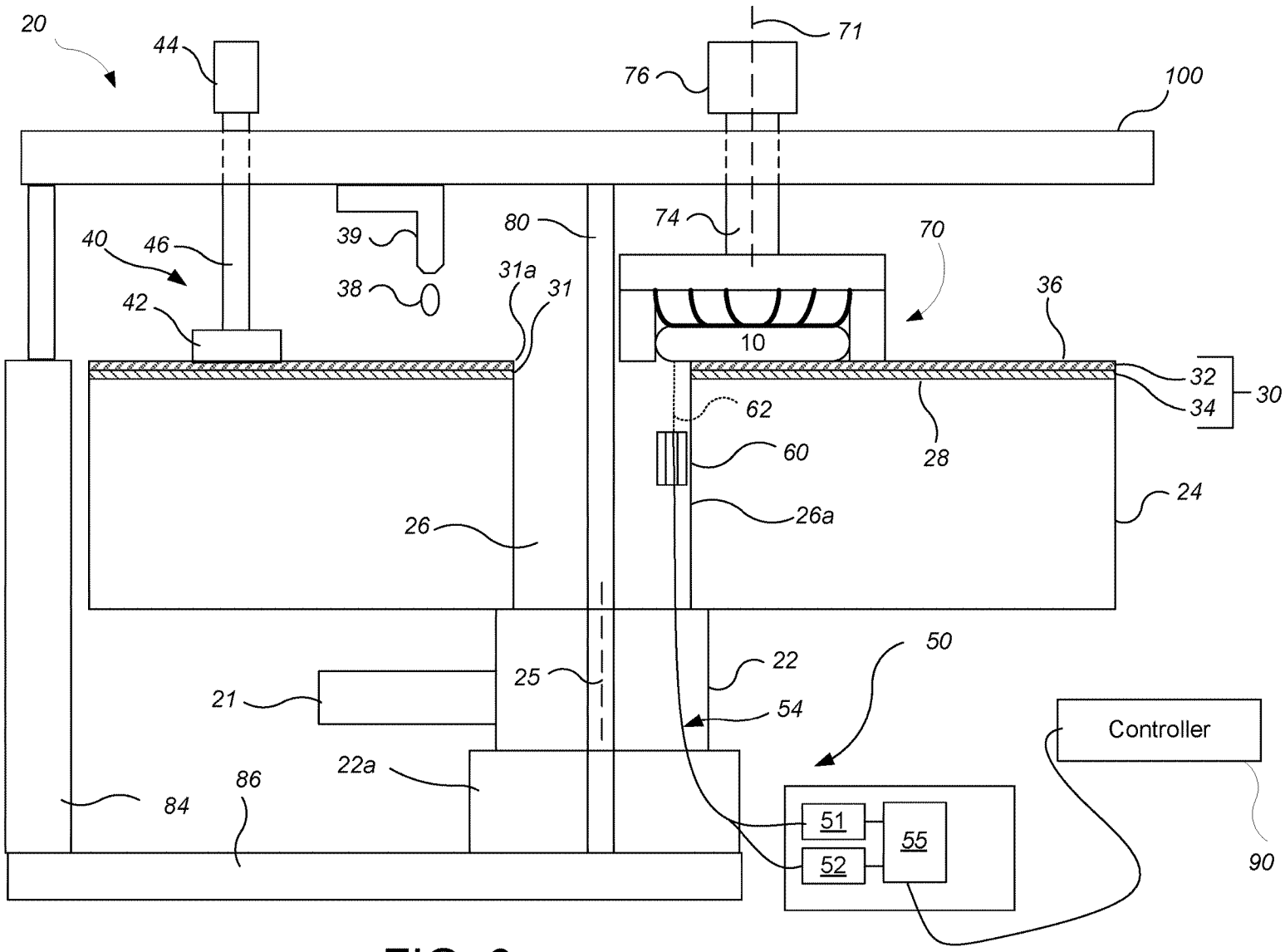
FIG. 6 shows a schematic cross-sectional view of a chemical mechanical polishing system in which a support post extends through an aperture in the platen.

Referring to FIG. 6, the support post 80 can be implemented in a system in which the aperture 26 extends entirely through the platen 24. For example, the support post 80 can extend entirely through the aperture 26, the cylindrical drive shaft 22, and the ring bearing 22*a* to have a lower end mounted on the frame from the polishing system 20.

In some implementations, the support structure 100 is supported only by the first support post 80. In this case the support structure is a cantilever structure that extends over the platen 24. However, this permits the components that would otherwise require room on the side of the platen to be supported by the post 80 at the center of the platen, which can reduced the footprint of the polishing system 20.

For operation of some implementations, e.g., where the probe 60 is positioned below the aperture 26 in the polishing pad 30 (e.g., as shown in FIGS. 1, 3, 5 and 6), the controller 90 can be configured to cause motors to move the carrier head 70 to a position in which the substrate 10 partially overhangs the aperture 26. That is, a portion of the substrate 10, e.g., at least half of the surface area of the substrate, will contact the polishing pad 30, whereas a remainder of the substrate will overhang the inside edge 31*a* of the hole 31 through the polishing pad 30. This can be done either intermittently during a polishing operation, or before and/or after the polishing operation.

Polishing by-product, e.g., used slurry or debris from polishing, can be disposed of through the hole 31 in the polishing pad and the aperture 26 in the platen. For example, where the aperture 26 is a recess, a conduit 29 (see FIG. 1) can connect to the bottom surface 27 of the aperture 26 to permit the fluid polishing by-product to drain away. Where the aperture 26 provides a passage through the platen, the aperture itself can provide the conduit for the fluid polishing by-product to drain away.

As used in the instant specification, the term substrate can include, for example, a product substrate (e.g., which includes multiple memory or processor dies), a test substrate, a bare substrate, and a gating substrate. The substrate can be at various stages of integrated circuit fabrication, e.g., the substrate can be a bare wafer, or it can include one or more deposited and/or patterned layers. The term substrate can include circular disks and rectangular sheets.

Embodiments of the controller 90 and its functional operations can be implemented in digital electronic circuitry, or in computer software, firmware, or hardware, such as one or more computer program products, i.e., one or more computer programs tangibly embodied in an information carrier, e.g., in a non-transitory machine-readable storage medium or in a propagated signal, for execution by, or to control the operation of, data processing apparatus, e.g., a programmable processor, a computer, or multiple processors or computers. The controller 90 can be provided by one or more programmable processors executing one or more computer programs to perform functions by operating on input data and generating output, or by special purpose logic circuitry, e.g., an FPGA (field programmable gate array) or an ASIC (application-specific integrated circuit).

The above described polishing system and methods can be applied in a variety of polishing systems. Either the polishing pad, or the carrier head, or both can move to provide relative motion between the polishing surface and the substrate. The polishing pad can be a circular (or some other shape) pad secured to the platen. The polishing layer can be a standard (for example, polyurethane with or without fillers) polishing material, a soft material, or a fixed-abrasive material. Terms of relative positioning are used; it should be understood that the polishing surface and substrate can be held in a vertical orientation or some other orientation.

Particular embodiments of the invention have been described. Other embodiments are within the scope of the following claims. For example, the actions recited in the claims can be performed in a different order and still achieve desirable results.

What is claimed is:

1. A polishing system, comprising:

a platen having a top surface and an aperture in the top surface in approximately a center of the platen such that the top surface is an annular surface to support an annular polishing pad, the polishing pad having a hole therethrough corresponding to the aperture of the platen, the platen rotatable about an axis of rotation that passes through the hole in the pad, through the aperture in the platen and through approximately the center of the platen; a carrier head to hold a substrate in contact with the annular polishing pad; and an in-situ monitoring system having a probe positioned in or below the aperture and configured to monitor an unsupported portion of the substrate that is positioned over the hole in the polishing pad such that the unsupported portion overhangs an inner edge of the hole in the pad and the annular surface of the platen.

2. The polishing system of claim 1, wherein the aperture comprises a recess extending partially but not entirely through the platen.

3. The polishing system of claim 2, comprising a conduit through the platen for liquid polishing residue to drain from the recess.

4. The polishing system of claim 1, wherein the aperture comprises a passage extending entirely through the platen.

5. The polishing system of claim 4, comprising a ring bearing supporting the platen.

6. The polishing system of claim 5, wherein the probe is supported on a structure that extends vertically through the ring bearing.

7. The polishing system of claim 4, wherein the probe is secured to a side wall of the aperture of the platen.

8. A polishing system, comprising:

a platen having a top surface, the platen rotatable about an axis of rotation that passes through approximately the center of the platen;

an annular polishing pad supported on the platen, the annular polishing pad having a hole therethrough with the axis of rotation passing through the hole in the polishing pad and with an inner edge of the hole of the annular polishing pad surrounding the axis of rotation;

a carrier head to hold a substrate in contact with the annular polishing pad;

a support structure from which the carrier head is suspended, the support structure configured to move the carrier head laterally across the polishing pad; and a controller configured to cause the support structure to position the carrier head such that a portion of the substrate overhangs the inner edge of the hole of the annular polishing pad while the substrate is contacting the polishing pad; further comprising an in-situ monitoring system having a probe positioned to monitor the portion of the substrate that overhangs the inner edge of the hole of the annular polishing pad.

9. The polishing system of claim 8, wherein a center of the hole that provides the inner edge of the annular polishing pad is aligned with the axis of rotation.

10. The polishing system of claim 8, wherein the platen has an aperture in the top surface in approximately a center of the platen such that the top surface is an annular surface to support the annular polishing pad.

11. The polishing system of claim 8, comprising a support post to support one or more polishing system components, the support post having a lower portion that is supported on the platen or that extends through an aperture in the platen.

* * * * *